US008998359B2

(12) United States Patent
Zhou et al.

(10) Patent No.: US 8,998,359 B2
(45) Date of Patent: Apr. 7, 2015

(54) METHOD AND APPARATUS FOR CONTROLLING MULTICOLOR OVERPRINT OF INTERMITTENT PRINT DEVICE

(71) Applicants: Peking University Founder Group Co., Ltd., Beijing (CN); Peking University, Beijing (CN); Beijing Founder Electronics Co., Ltd., Beijing (CN)

(72) Inventors: Zhengsheng Zhou, Beijing (CN); Hong Shen, Beijing (CN); Feng Chen, Beijing (CN); Zhihong Liu, Beijing (CN)

(73) Assignees: Peking University Founder Group Co., Ltd., Beijing (CN); Peking University, Beijing (CN); Beijing Founder Electronics Co., Ltd., Beijing (CN)

( * ) Notice: Subject to any disclaimer, the term of this patent is extended or adjusted under 35 U.S.C. 154(b) by 0 days.

(21) Appl. No.: 14/127,840

(22) PCT Filed: Dec. 28, 2012

(86) PCT No.: PCT/CN2012/087897

§ 371 (c)(1),
(2) Date: Dec. 19, 2013

(87) PCT Pub. No.: WO2013/097776

PCT Pub. Date: Jul. 4, 2013

(65) Prior Publication Data

US 2014/0313249 A1 Oct. 23, 2014

(30) Foreign Application Priority Data

Dec. 30, 2011 (CN) ..... 2011 1 0457705

(51) Int. Cl.
*B41J 29/38* (2006.01)
*B41J 2/21* (2006.01)
(Continued)

(52) U.S. Cl.
CPC ..... *B41J 2/2103* (2013.01); *B41F 13/04* (2013.01); *B41J 2/2135* (2013.01); *B41J 2/155* (2013.01)

(58) Field of Classification Search
USPC ..... 347/9, 12, 14, 16, 37, 43; 355/326, 327
See application file for complete search history.

(56) References Cited

U.S. PATENT DOCUMENTS

| | | | | |
|---|---|---|---|---|
| 4,933,727 | A * | 6/1990 | Mizuma et al. | 399/298 |
| 5,335,055 | A * | 8/1994 | Bliss | 399/155 |
| 7,168,783 | B2 * | 1/2007 | Naito | 347/37 |

(Continued)

FOREIGN PATENT DOCUMENTS

| | | |
|---|---|---|
| CN | 101372172 A | 2/2009 |
| CN | 101772417 A | 7/2010 |

(Continued)

OTHER PUBLICATIONS

International Search Report dated Apr. 4, 2013 from International Patent Application No. PCT/CN2012/087897 filed Dec. 28, 2012.

*Primary Examiner* — Arleen M Vazquez
*Assistant Examiner* — Tuan A Hoang
(74) *Attorney, Agent, or Firm* — Workman Nydegger

(57) ABSTRACT

Disclosed are a multicolor overprint control method and device applicable to an intermittent printing apparatus. According to the operating characteristic of the intermittent printing apparatus, the method solves the problems of overlap and inaccurate overprint of various colors during intermittent printing by controlling the relationship between the distance between adjacent color group modules of different colors and the motion distance between uniform segments of the intermittent printing apparatus. In addition, the method also sets different inkjet printing modes in accordance with whether the detected inkjet printing of the same color group module is in a first period, thereby solving the problems of printing media waste and discontinuous printing data. The method achieves multicolor digital inkjet printing by combining the unique motion mode of the printing media thereof, and makes printing contents flexible and changeable on the basis of guaranteeing printing efficiency.

17 Claims, 5 Drawing Sheets

(51) Int. Cl.
*B41F 13/04* (2006.01)
*B41J 2/155* (2006.01)

(56) References Cited

U.S. PATENT DOCUMENTS

| | | | | |
|---|---|---|---|---|
| 2004/0160477 | A1* | 8/2004 | Khalid | 347/43 |
| 2014/0002532 | A1* | 1/2014 | Huang et al. | 347/16 |

FOREIGN PATENT DOCUMENTS

| | | | |
|---|---|---|---|
| CN | 202053680 | U | 11/2011 |
| CN | 102463744 | A | 5/2012 |
| CN | 102529343 | A | 7/2012 |
| JP | 2010-036447 | A | 2/2010 |

* cited by examiner

METHOD AND APPARATUS FOR CONTROLLING MULTICOLOR OVERPRINT OF INTERMITTENT PRINT DEVICE

The present application is a US National Stage of International Application No. PCT/CN2012/087897, filed 28 Dec. 2012, designating the United States, and claiming priority to Chinese Patent Application No. 201110457705.2, filed with the Chinese Patent Office on Dec. 30, 2011 and entitled "METHOD AND APPARATUS FOR CONTROLLING MULTICOLOR OVERPRINT OF INTERMITTENT PRINT DEVICE", which is hereby incorporated by reference in its entirety.

FIELD OF THE INVENTION

The present invention relates to the field of digital inkjet print and particularly to a method and apparatus for controlling accurate multicolor overprint applicable to an intermittent rotated print device.

BACKGROUND OF THE INVENTION

An intermittent rotated print device is a new type of device emerging in the industry of self-adhesive label print in recent years. Along with the development of the market, there are increasingly demands of customers for personalized labels, but steps of a traditional print process for formatting and proofing are cumbersome and costly, so computer and control technologies can be introduced to digital inkjet print to have jet-print data directly transmitted, processed and jet-printed to thereby make the print process simple, rapid and convenient and make contents of print products flexible and variable.

In an operating process of the majority of digital inkjet print devices, a print medium moves relative to an imaging component for the purpose of continuous print. Due to the limited resolution and breadth of the imaging component itself, the majority of the digital inkjet print devices have their resolutions improved through interleaved superimposition and print breadths improved through transverse splicing. A digital jet-head print device can also perform color print with additional imaging components in different colors. Specifically the digital jet-head print device performs non-contact print in which the location of an ink drop on a print material is controlled precisely with some control technology, so digital inkjet print generally can be combined with a rotated device for convenient control of the precise location of an ink drop on the print material. However there has been absent an application of multicolor digital inkjet print on an intermittent print device in a complex motion condition of a print medium.

Particularly a primary motion form of the intermittent print device is intermittent motion. FIG. 1 generally illustrates its operating process in a cycle. A print roller is rotated at a uniform speed in the same direction, and when a print plate comes into contact with a print medium, a paper pulling roller, a paper feeding roller and the print roller are kept in synchronization (with an instant relative speed being zero) to start print. These three rollers are kept in synchronization throughout the print process. The print plate leaves the print medium to finish print. At this time the paper pulling roller and the paper feeding roller firstly are decelerated to zero and at rest for a period of time and then are rotated reversely, and a second print cycle is started when the print roller is rotated to the state that the print plate comes into contact with the print medium again. A direction application of the existing digital inkjet print system to the intermittent device may suffer the problems of overlapped print, misaligned multicolor overprint, etc.

SUMMARY OF THE INVENTION

In view of the drawbacks in the prior art, an object of the invention is to provide a method and apparatus for controlling multicolor overprint applicable to an intermittent print device so as to integrate a multicolor digital inkjet print system fully with the intermittent rotated print device and provide a new combined print solution while ensuring the efficiency of print.

In order to attain the foregoing object, the invention adopts the following technical solutions.

A method for controlling multicolor overprint applicable to an intermittent print device includes the steps of:

(1) obtaining a start time signal of a uniform-speed section in an intermittent motion cycle of the intermittent print device;

(2) setting the intermittent print device to start operation upon detection of a start time signal of a uniform-speed section so that a first color module starts inkjet print until an end time of the uniform-speed section, wherein the color module is a module into which multiple spliced imaging components in the same color are combined; and (3) following the end of motion in the uniform-speed section of the current color module, starting inkjet print by a next color module together with a start time signal of a uniform-speed section until an end time of the uniform-speed section, and repeating the step (3) until all the color modules in colors finish print.

Furthermore in the method for controlling multicolor overprint applicable to an intermittent print device, between the step (1) and the step (2), the method further includes:

(1-1) adjusting a spacing between adjacent color modules so that the spacing between the adjacent color modules is N times a motion distance L in the uniform-speed section, wherein N is a positive integer.

Furthermore in the method for controlling multicolor overprint applicable to an intermittent print device, in the step (3), after a period of time which is N times a motion period of time of the uniform-speed section elapses from a start time of the uniform-speed section of the current color module, the next color module starts inkjet print until the end time of the uniform-speed section.

Furthermore in the method for controlling multicolor overprint applicable to an intermittent print device, a print breadth in the same color is improved by splicing imaging components in a direction of an X axis in the step (2).

Furthermore in the method for controlling multicolor overprint applicable to an intermittent print device, the imaging components are spliced in the direction of the X axis by splicing imaging components of the same color module alternately in the form of "品", wherein a spacing between adjacent imaging components in a direction of a Y axis is represented as d with $0<d<L$, and L represents a motion distance in the uniform-speed section.

Furthermore in the method for controlling multicolor overprint applicable to an intermittent print device, for inkjet print at the start time of the uniform-speed section, firstly an imaging component in the same color module relatively forward in the direction of the Y axis performs inkjet print and then an imaging component relatively backward performs inkjet print at the delay distance d.

Still furthermore in the method for controlling multicolor overprint applicable to an intermittent print device, the same color module performs inkjet print in the uniform-speed section of the intermittent print device further includes:

starting inkjet print by checking whether it is a first cycle of intermittent print; and if so, then firstly the imaging component in the color module relatively forward in the direction of the Y axis performing inkjet print and then the imaging component relatively backward performing inkjet print at the delay distance d; otherwise, the imaging components forward and backward in the color module performing inkjet print at the same time.

Still furthermore in the method for controlling multicolor overprint applicable to an intermittent print device, the imaging component relatively backward performs print for a distance of L-d in the first cycle of intermittent print.

An apparatus for controlling multicolor overprint applicable to an intermittent print device includes:

a uniform-speed section parameter calculating module configured to obtain a start time signal of a uniform-speed section in an intermittent motion cycle of the intermittent print device;

a first color module jet-print module configured to set the intermittent print device to start operation upon detection of a start time signal of a uniform-speed section so that a first color module starts inkjet print until an end time of the uniform-speed section, wherein the color module is a module into which multiple spliced imaging components in the same color are combined; and an another-color module jet-print module configured to cause a next color module following the end of motion in the uniform-speed section of the current color module to start inkjet print together with a start time signal of a uniform-speed section until an end time of the uniform-speed section and to repeat the foregoing process until all the color modules in colors finish print.

Furthermore in the apparatus for controlling multicolor overprint applicable to an intermittent print device, the apparatus further includes:

a color module spacing setting module configured to adjust a spacing between adjacent color modules so that the spacing between the adjacent color modules is N times a motion distance L in the uniform-speed section, wherein N is a positive integer.

Furthermore in the apparatus for controlling multicolor overprint applicable to an intermittent print device, after a period of time which is N times a motion period of time of the uniform-speed section elapses from a start time of the uniform-speed section of the current color module, the another-color module jet-print module causes the next color module to start inkjet print until the end time of the uniform-speed section.

Furthermore in the apparatus for controlling multicolor overprint applicable to an intermittent print device, the color module has a print breadth in the same color improved by splicing imaging components in a direction of an X axis, and a spacing between adjacent imaging components in the same color module in a direction of a Y axis is represented as d with $0<d<L$, and L represents a motion distance in the uniform-speed section.

Still furthermore in the apparatus for controlling multicolor overprint applicable to an intermittent print device, the first color module jet-print module and the another-color module jet-print module perform inkjet print at the start times of the uniform-speed sections in such a way that an imaging component in the same color module relatively forward in the direction of the Y axis performs inkjet print and then an imaging component relatively backward performs inkjet print at the delay distance d.

Effects of the invention lie in that: the method and apparatus according to the invention can be applicable directly to the existing intermittent rotated device, make full use of the advantages of the intermittent rotated device itself and perform multicolor digital inkjet print in combination with the unique motion pattern of the print medium, thereby addressing the problem of overprint during print by the intermittent rotated device combined with digital inkjet print and introducing a new print process while ensuring the full efficiency of print to make print contents more flexible and variable.

DETAILED DESCRIPTION OF THE EMBODIMENTS

Firstly a technical disclosure and a general idea of the invention will be introduced briefly in order to make a technical solution of the invention more apparent.

Figure 1:
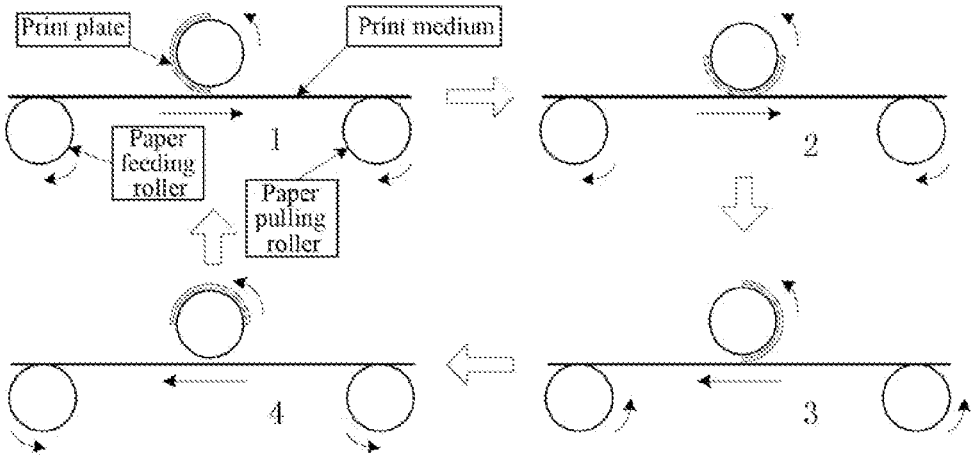
FIG. 1 is a schematic diagram of a print cycle of an intermittent print device.
Figure 2:
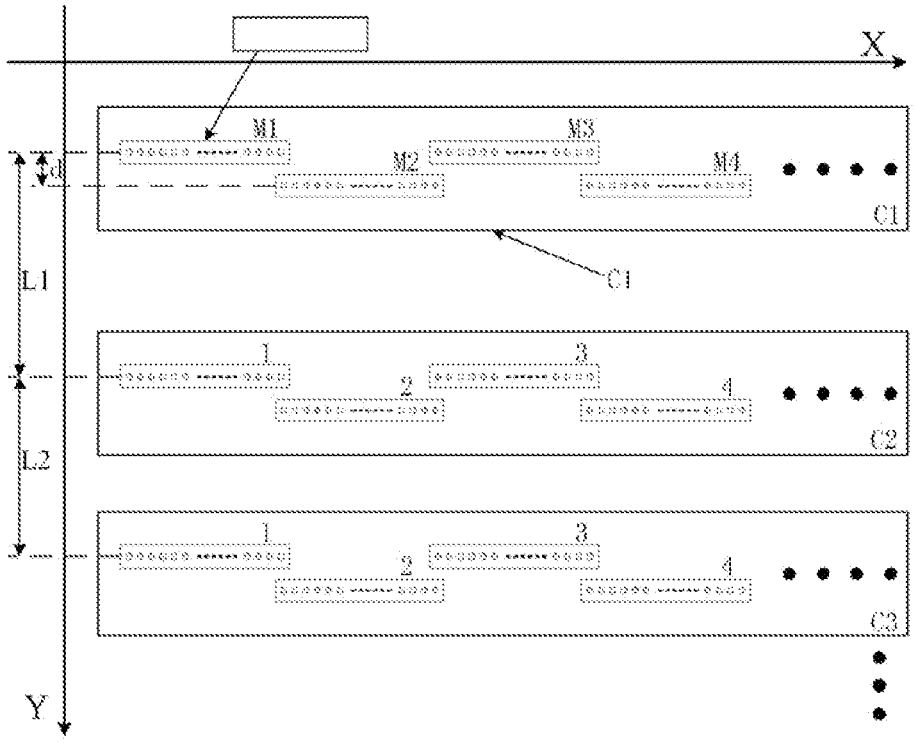
FIG. 2 is a schematic diagram of multicolor and multi-section digital jet-print.

Due to the limited physical width of a single imaging component, a real print breadth can be improved for the same color through splicing in the direction of the X axis as illustrated in FIG. 2 where a print breadth is improved by splicing imaging components M1, M2, M3, . . . . In order to ensure seamless splicing between two adjacent imaging components, the invention has the adjacent imaging components spliced in the direction of the X axis with some spacing d present between them in the direction of the Y axis in view of their housings, mechanical installation difficulty and other factors. A digital inkjet print system manages data of each imaging component separately and controls the data to be output with a delay so as to address the problem of imaging due to the spacing d between the imaging components.

Figure 3:
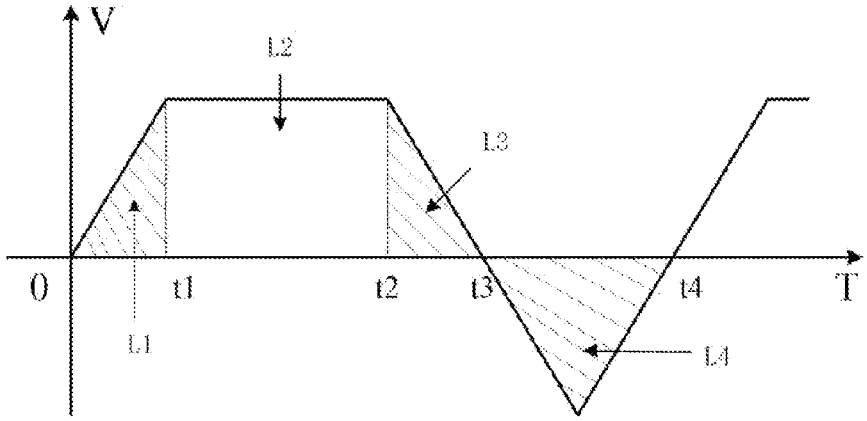
FIG. 3 is a simplified schematic diagram of an intermittent print cycle.

In the invention, such combination of these spliced multiple imaging components in the same color is referred to as a "color module" as illustrated in FIG. 2 where the imaging components M1, M2, M3, . . . are spliced into a color module C1. Multicolor print is performed by adding "color modules" in different colors, for example, color modules C1, C2, C3, . . . as illustrated in FIG. 2. A direct application of a multicolor overprint method on a fully rotated device to an intermittent print device will inevitably result in the problem of misaligned multicolor overprint due to the intermittent motion form of the intermittent device. The unique motion pattern of the intermittent rotated print device decides a unique control pattern of digital inkjet print. As illustrated in FIG. 3, each intermittent motion cycle is divided into four steps of Forward Acceleration (0-t1), Forward Uniform Speed (t1-t2), Forward Deceleration (t2-t3) and Backward (t3-t4), and motion distances in the respective sections are represented respectively as the areas L1, L2, L3 and L4 of four corresponding sections in FIG. 3. A real progression distance of each cycle is calculated as L=L1+L2+L3−L4 due to reverse motion in the L4 section. In order to prevent sufficiently the displacement in the section of Forward Uniform Speed from being cancelled in the section of Backward, the intermittent motion cycle is typically set that L1+L3=L4, so the real progression distance of each cycle (typically referred to as a "span") is L=L2. Jet-print of an image over a span of the length L in each cycle of digital inkjet print will be sufficient due to the limited span L of intermittent motion. In a method for controlling multicolor inkjet print on an intermittent rotated device in a multicolor digital inkjet print system according to the invention, inkjet print can be performed in this section of Forward Uniform Speed to thereby control precisely the location where an ink drop is imaged. Multicolor overprint is performed by firstly adjusting the spacing between adjacent modules in two colors to be exactly integer N times the distance in the section of Uniform Speed so that when the module in the first color detects a signal in the section of Uniform Speed and starts inkjet print, the adjacent module in the second color records this moment of time and also starts inkjet print with a delay of N times the distance in the section of Uniform Speed to thereby result in precise dichromatic overprint.

The invention will be further described below in details with reference to the drawings and particular embodiments thereof.

Figure 4:
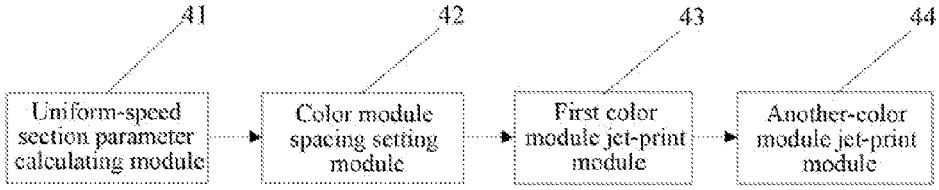
FIG. 4 is a block diagram of a structure of an apparatus for controlling multicolor overprint applicable to an intermittent print device.

FIG. 4 illustrates a block diagram of a structure of an apparatus for controlling multicolor overprint applicable to an intermittent print device, and as can be apparent from the figure, the apparatus generally includes the following modules.

A uniform-speed section parameter calculating module 41 is configured to obtain a start time signal of a uniform-speed section in an intermittent motion cycle of the intermittent print device.

A first color module jet-print module 43 is configured to set the intermittent print device to start operation upon detection of a start time signal of a uniform-speed section so that a first color module starts inkjet print until an end time of the uniform-speed section, where the color module refers to a module into which multiple spliced imaging components in the same color are combined.

An another-color module jet-print module 44 is configured to cause a next color module at the end of motion in the uniform-speed section of the current color module to start inkjet print together with a start time signal of a uniform-speed section until an end time of the uniform-speed section and to repeat the foregoing process until all the color modules in colors finish print.

Since a motion cycle of intermittent print of the existing intermittent print device is divided into four sections of Acceleration, Uniform Speed, Deceleration and Backward, for the purpose of better cooperation with the foregoing characteristic of the existing intermittent print device, the inventive apparatus further includes a color module spacing setting module 42 configured to adjust the spacing between adjacent color modules so that the spacing between the adjacent color modules is N times a motion distance L in the uniform-speed section, where N is a positive integer. Thus the spacing between the adjacent color modules is N times the distance over which the intermittent print device moves in the uniform-speed section (a real distance over which a print progresses), the succeeding color module performs print after a period of time which is N times a uniform-speed period of time of the uniform-speed section elapses after the preceding color module starts print, thereby well ensuring overprint between the color modules. Of course the color module spacing setting module 42 configured for cooperation with the characteristic of the existing intermittent print device is not necessary, but the device can be ensured otherwise to perform inkjet print only in the motion period of time of the uniform-speed section, for example, if all the four sections of the device are uniform-speed sections, then the color module can perform inkjet print at the distance L in the uniform-speed forward section without setting the distance of the adjacent color modules to be N times the distance in the uniform-speed section.

First Embodiment

Figure 5:
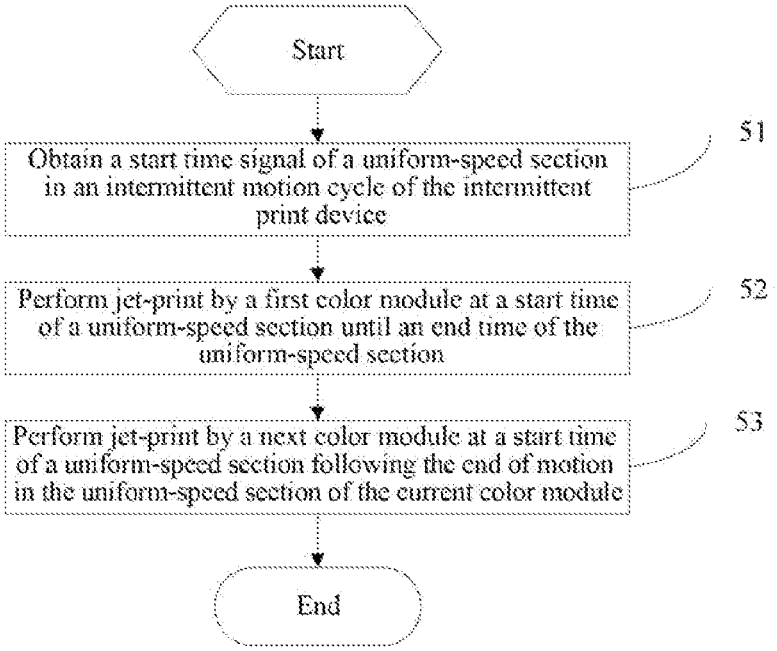
FIG. 5 is a flow chart of a method for controlling multicolor overprint applicable to an intermittent print device in a first embodiment.

FIG. 5 illustrates a flow chart of a method for controlling multicolor overprint applicable to an intermittent print device in this embodiment, the method generally including the following steps.

Step S51 is to obtain a start time signal of a uniform-speed section in an intermittent motion cycle of the intermittent print device.

A motion period of time of a uniform-speed section in an intermittent motion cycle of the intermittent print device is detected, a start time signal of the uniform-speed section in the intermittent motion cycle of the intermittent print device is obtained, start and end times of the uniform-speed section are recorded, and a motion distance L in the uniform-speed section is calculated.

Step S52 is to perform jet-print by a first color module at a start time of a uniform-speed section until an end time of the uniform-speed section.

The intermittent print device is set to start operation upon detection of a start time signal of a uniform-speed section so that a first color module starts inkjet print until an end time of the uniform-speed section. As can be apparent from the foregoing description, a real progression distance in each intermittent motion cycle of intermittent motion is a progression distance in a uniform-speed motion section, so the intermittent print device starts inkjet print together with the start time signal of the uniform-speed section to perform print by the first color module until the end time of the uniform-speed section to thereby ensure print to be performed only in the uniform-speed section.

Particularly the color module refers to a module into which multiple spliced imaging components in the same color are combined, and in a practical inkjet print process, if the width of data to be jet-printed is larger than the width of a single imaging component due to the limitation thereof, then multiple identical imaging components are spliced in the direction of the X axis to improve the print breadth in the same color for the purpose of extension. In this embodiment, the imaging components are spliced in the direction of the X axis by splicing imaging components of the same color module alternately in the form of "品", thus inevitably resulting in the spacing between jet heads of two adjacent imaging components in the direction of the Y axis, denoted as d with $0<d<L$, where L is the motion distance in the uniform-speed section.

Step S53 is to perform jet-print by a next color module at a start time of a uniform-speed section following the end of motion in the uniform-speed section of the current color module.

A next color module starts inkjet print together with a start time signal of a uniform-speed section following the end of motion in the uniform-speed section of the current color module, and this step is repeated until all the color modules in colors finish print. After a color module finishes inkjet print in a uniform-speed section, a next color module performs inkjet print upon arrival of a start time signal of a next uniform-speed section to thereby ensure that all the color modules perform print only in a uniform-speed section.

Specifically following the end of motion of the current color module in the uniform-speed section, the next color module can perform inkjet print upon arrival of the start time signal of the next uniform-speed section, but the invention will not be limited in this respect, alternatively, the next color module can perform inkjet print after a period of time which is N times the motion period of time of the uniform-speed section elapses, thereby well ensuring that all the color modules perform print only in a uniform-speed section.

Figure 6:
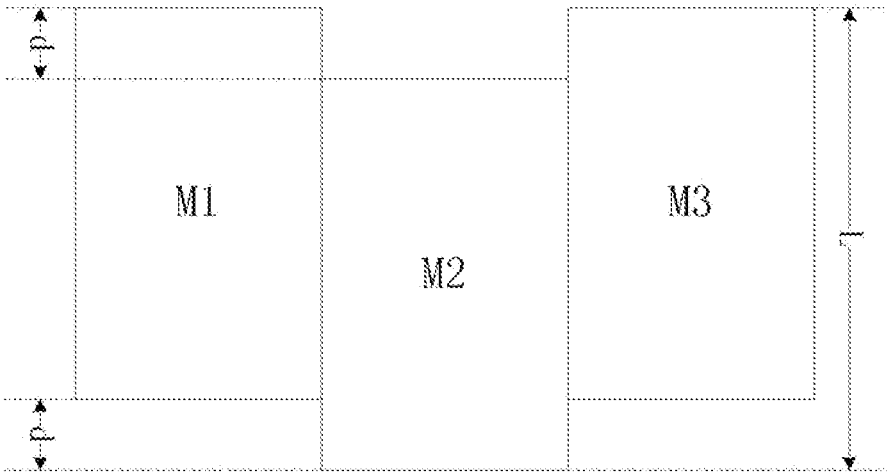
FIG. 6 is a schematic diagram of an effect of jet-print an image in a cycle.

For inkjet print at a start time of a uniform-speed section, since there is a spacing d in the direction of the Y axis between jet heads of adjacent imaging components in the same color module, the same color module performs inkjet print in such a way that firstly the imaging component relatively forward in the direction of the Y axis performs inkjet print and then the imaging component relatively backward performs inkjet print at a delay distance d. As illustrated in FIG. 6, the device is controlled to perform inkjet print upon arrival of a forward uniform-speed section, the print medium passes firstly the imaging components M1 and M3 and then M2, and the imaging component M2 is controlled to start jet-print after a delay distance d from the imaging components M1 and M3, thus making it possible to keep jet-print data consistent in the direction of the X axis.

In the inkjet print process, if the length of imaging data is smaller than L-d, then a print image can be processed in an intermittent motion cycle, but an obvious drawback of imaging in this control pattern is that the length of imaging data has to be smaller than L-d, thus resulting in a waste of an imaging medium with a length of d in each cycle and discontinued imaging across adjacent cycles. In view of this waste problem, the control pattern can be modified for continued imaging and avoidance of the waste of the print medium with a length of d in each cycle, particularly as follows.

Figure 7:
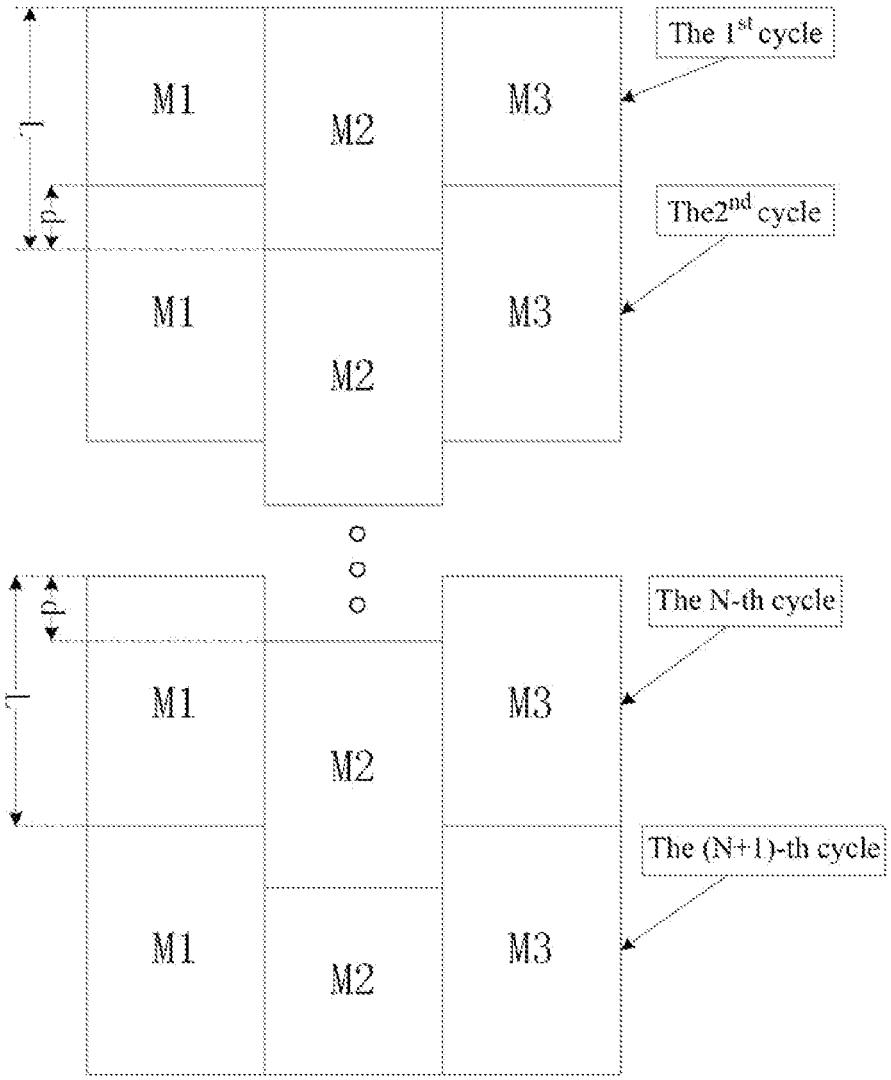
FIG. 7 is a schematic diagram of a real jet-print effect in an intermittent motion cycle.

For inkjet print by the same color module, a first cycle is detected after print is started, and if the first cycle is detected, then imaging is performed as above (firstly an imaging component relatively forward in the direction of the Y axis performs inkjet print and then an imaging component relatively backward performs inkjet print at a delay distance d), and both of the imaging component forward and backward start inkjet print at the same time in a uniform-speed forward section of a second cycle, thus achieving seamless connection with the preceding cycle, until all of data have been jet-printed as illustrated in FIG. 7. This implementation will avoid a waste of the print medium with a length of d in each cycle and ensure the continuity of print data.

Second Embodiment

Figure 8:
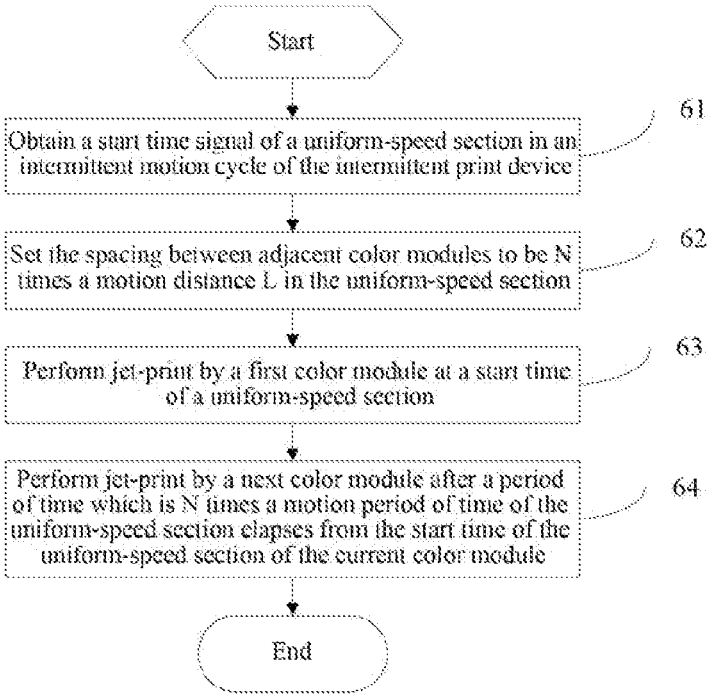
FIG. 8 is a flow chart of a method for controlling multicolor overprint applicable to an intermittent print device in a second embodiment.

FIG. 8 illustrates a flow chart of a method for controlling multicolor overprint applicable to an intermittent print device in this embodiment, and as can be apparent from the figure, the method generally includes the following steps.

Step S61 is to obtain a start time signal of a uniform-speed section in an intermittent motion cycle of the intermittent print device.

A motion period of time of a uniform-speed section in an intermittent motion cycle of the intermittent print device is detected, and a motion distance L in the uniform-speed section is calculated. As can be apparent from the foregoing description, a real progression distance in each intermittent motion cycle of intermittent motion is a progression distance in a uniform-speed motion section, and start and end times of the intermittent motion cycle are detected so that the motion period of time of the uniform-speed section can be derived, and the motion distance L in the uniform-speed section can be calculated, where this distance is commonly referred to as a "span"

Step 62 is to set the spacing between adjacent color modules to be N times a motion distance L in the uniform-speed section.

The spacing between adjacent color modules is adjusted so that the spacing between the adjacent color modules is N times a motion distance L in the uniform-speed section, where N is a positive integer; and the color module refers to a module into which multiple spliced imaging components in the same color are combined.

In practical inkjet print, if the width of data to be jet-printed is larger than the width of a single imaging component due to the limitation thereof, then multiple identical imaging components are spliced in the direction of the X axis to improve the print breadth in the same color for the purpose of extension. In this embodiment, the imaging components are spliced in the direction of the X axis by splicing imaging components of the same color module alternately in the form of "品", thus inevitably resulting in the spacing between jet heads of two adjacent imaging components in the direction of the Y axis, denoted as d with $0<d<L$.

Step S63 is to perform jet-print by a first color module at a start time of a uniform-speed section.

Upon detection of a start time signal of a uniform-speed section of the intermittent print device, a first color module starts inkjet print until an end time of the uniform-speed section. For inkjet print at a start time of a uniform-speed section, since there is a spacing d in the direction of the Y axis between jet heads of adjacent imaging components in the same color module, the same color module performs inkjet print in such a way that firstly the imaging component relatively forward in the direction of the Y axis performs inkjet print and then the imaging component relatively backward performs inkjet print at a delay distance d. As illustrated in FIG. 6, the device is controlled to perform inkjet print upon arrival of a forward uniform-speed section, the print medium passes firstly the imaging components M1 and M3 and then M2, and the imaging component M2 is controlled to start jet-print after a delay distance d from the imaging components M1 and M3, thus making it possible to keep jet-print data consistent in the direction of the X axis.

In the inkjet print process, if the length of imaging data is smaller than L-d, then a print image can be processed in an intermittent motion cycle, but imaging in this control pattern refigures the length of imaging data to be smaller than L-d, thus resulting in a waste of an imaging medium with a length of d in each cycle and discontinued imaging across adjacent cycles. In view of this waste problem, the control pattern can be modified for continued imaging and avoidance of the waste of the print medium with a length of d in each cycle, particularly as follows.

For inkjet print by the same color module, a first cycle is detected after print is started, and if the first cycle is detected, then imaging is performed as above (firstly an imaging component relatively forward in the direction of the Y axis performs inkjet print and then an imaging component relatively backward performs inkjet print at a delay distance d), and both of the imaging component forward and backward start inkjet print at the same time in a uniform-speed forward section of a second cycle, thus achieving seamless connection with the preceding cycle, until all of data have been jet-printed as illustrated in FIG. 7. This implementation will avoid a waste of the print medium with a length of d in each cycle and ensure the continuity of print data.

Step S64 is to perform jet-print by a next color module after a period of time which is N times a motion period of time of the uniform-speed section elapses from the start time of the uniform-speed section of the current color module.

Since the spacing between the adjacent color modules is N times the distance over which the intermittent print device moves in the uniform-speed section (a real distance over which a print progresses), the start time of the uniform-speed section of the current color module is recorded, and then a next color module performs print after a period of time which is N times a uniform-speed period of time of the uniform-speed section elapses from the start time, thereby well ensuring overprint between the color modules. After the period of time which is N times the motion period of time of the uniform-speed section of the current color module elapses from the start time, the next color module starts inkjet print until an end time of a uniform-speed section, and this step is repeated until all the color modules in colors finish print. Each time a color module finishes inkjet print, the print start time of inkjet print by the current color module is recorded in the step S54, and a next color module performs jet-print after a period of time which is N times the motion period of time of the uniform-speed section elapses, thereby ensuring accurate superimposition of data jet-print in different colors.

Figure 9:
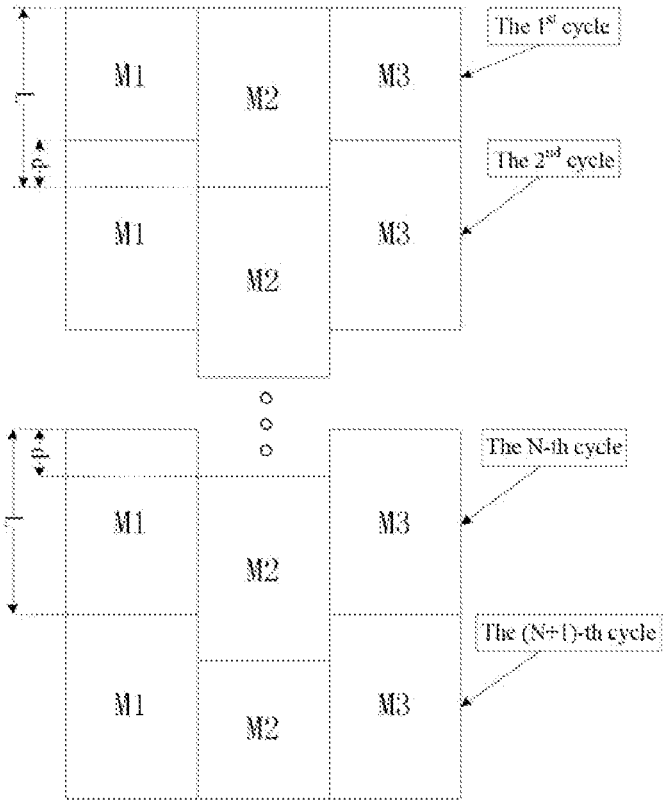
FIG. 9 is a schematic diagram of dichromatic overprint.

In order to enable color digital inkjet print on an intermittent printer, multicolor overprint can be further performed based upon continued normal jet-print in the same color in the foregoing steps. As illustrated in FIG. 9 where imaging data in different colors are represented by oblique lines in different directions for a more intuitive description of an implementation of multicolor overprint, imaging contents in the different colors are superimposed over each other for final imaging on the print medium. The inventive apparatus controls data for imaging of each color module separately, and the print medium moves starting from the color module C1 to C2 further to C3. With the spacing between two color modules adjusted in the step S62 to N (N is a positive integer) times the span, after jet-print is started after the print medium passes the color module C1, a counter in the inventive apparatus starts counting the number of cycles of intermittent motion, and imaging components in the color module C2 start jet-print upon counting to the N-th cycle and entering a uniform-speed forward section, thereby ensuring accurate superimposition of data jet-print in two colors at the same physical location on the print medium. When there are multiple color modules, full multicolor overprint can be performed simply by a delay of a consistent number of intermittent motion cycles while controlling the spacing between every two adjacent color modules to be an integer multiples of the span.

In order to perform the foregoing method for controlling multicolor overprint applicable to an intermittent printer, the control apparatus according to the invention generally performs the control flow in FIG. 5 or FIG. 8 with some general hardware devices including a register, a counter, a data buffer, an adder, etc., so that the inventive method has good immediacy, high controllability, stable performance and easiness to implement. An operating flow of the hardware apparatus is as follows.

1. Data to be jet-printed are processed into dot matrix data and distributed into data buffers of respective imaging components of respective color modules, and system parameters, for example, the value of a, the value of the span L, the value of the spacing N from the first color module, etc., are stored in a set of registers.

2. A current color module is checked as to whether it is the first color module, and if it is the first color module, then print is performed directly, and if it is another color module, then a motion cycle counter is started until there is a count of N at which print is started.

3. Data to be jet-printed of the same color module is checked as to whether it is for a first cycle, and if it is data for the first cycle, then the imaging component M2 starts print by a length of (L-d) at a delay distance d after the imaging components M1 and M3 start print; and if it is not for the first cycle, then all the color modules output their respective image data at the same time upon arrival of a uniform-speed section. This is repeated cyclically until all the data have been printed. Each color module has its own print flow managed separately during print in the uniform-speed section of each intermittent motion cycle.

In summary, the data processing method and apparatus according to the invention can be applicable directly to the existing intermittent rotated device. The invention makes full use of the advantages of the intermittent rotated device itself and performs multicolor digital inkjet print in combination with the unique motion pattern of the print medium. This will introduce both a new print process and a new combined print pattern for combined print.

Those skilled in the art shall appreciate that the embodiments of the invention can be embodied as a method, a system or a computer program product. Therefore the invention can be embodied in the form of an all-hardware embodiment, an all-software embodiment or an embodiment of software and hardware in combination. Furthermore the invention can be embodied in the form of a computer program product embodied in one or more computer useable storage mediums (including but not limited to a disk memory, a CD-ROM, an optical memory, etc.) in which computer useable program codes are contained.

The invention has been described in a flow chart and/or a block diagram of the method, the device (system) and the computer program product according to the embodiments of the invention. It shall be appreciated that respective flows and/or blocks in the flow chart and/or the block diagram and combinations of the flows and/or the blocks in the flow chart and/or the block diagram can be embodied in computer program instructions. These computer program instructions can be loaded onto a general-purpose computer, a specific-purpose computer, an embedded processor or a processor of another programmable data processing device to produce a machine so that the instructions executed on the computer or the processor of the other programmable data processing device create means for performing the functions specified in the flow(s) of the flow chart and/or the block(s) of the block diagram.

These computer program instructions can also be stored into a computer readable memory capable of directing the computer or the other programmable data processing device to operate in a specific manner so that the instructions stored in the computer readable memory create an article of manufacture including instruction means which perform the functions specified in the flow(s) of the flow chart and/or the block(s) of the block diagram.

These computer program instructions can also be loaded onto the computer or the other programmable data processing device so that a series of operational steps are performed on the computer or the other programmable data processing device to create a computer implemented process so that the instructions executed on the computer or the other programmable data processing device provide steps for performing the functions specified in the flow(s) of the flow chart and/or the block(s) of the block diagram.

Although the preferred embodiments of the invention have been described, those skilled in the art benefiting from the underlying inventive concept can make additional modifications and variations to these embodiments. Therefore the appended claims are intended to be construed as encompassing the preferred embodiments and all the modifications and variations coming into the scope of the invention.

Evidently those skilled in the art can make various modifications and variations to the invention without departing from the scope of the invention. Thus the invention is also intended to encompass these modifications and variations thereto so long as the modifications and variations come into the scope of the claims appended to the invention and their equivalents.

The invention claimed is:

1. A method for controlling multicolor overprint applicable to an intermittent print device, comprising steps of:

(1) obtaining a start time signal of a uniform-speed section in an intermittent motion cycle of the intermittent print device;

(2) setting the intermittent print device to start operation upon detection of the start time signal of the uniform-speed section so that a first color module starts inkjet print until an end time of the uniform-speed section, wherein the first color module is a module into which multiple spliced imaging components in the same color are combined; and (3) following the end of motion in the uniform-speed section of the current color module, starting inkjet print by a next color module together with a next color start time signal of a next color uniform-speed section until the end time of the next color uniform-speed section, and repeating the step (3) until all the color modules in colors finish print.

2. The control method according to claim 1, wherein between the step (1) and the step (2), the method further comprises:

(1-1) adjusting a spacing between adjacent color modules so that the spacing between the adjacent color modules is N times a motion distance L in the uniform-speed section, wherein N is a positive integer.

3. The control method according to claim 2, wherein in the step (3), after a period of time which is N times a motion period of time of the uniform-speed section elapses from the start time of the uniform-speed section of the current color module, the next color module starts inkjet print until the end time of the next color uniform-speed section.

4. The control method according to claim 1, wherein a print breadth in the same color is improved by splicing imaging components in a direction of an X axis in the step (2).

5. The control method according to claim 4, wherein the imaging components are spliced in the direction of an X axis by splicing imaging components of the same color module alternately in the form of "", wherein a spacing between adjacent imaging components in the direction of a Y axis is represented as d with $0<d<L$, and L represents a motion distance in the uniform-speed section.

6. The control method according to claim 5, wherein for inkjet print at the start time of the uniform-speed section, firstly an imaging component in the same color module relatively forward in the direction of the Y axis performs inkjet print and then an imaging component relatively backward performs inkjet print at the delay distance d.

7. The control method according to claim 6, wherein the same color module performs inkjet print in the uniform-speed section of the intermittent print device further comprises:

starting inkjet print by checking whether it is a first cycle of intermittent print; and if so, then firstly the imaging component in the color module relatively forward in the direction of the Y axis performing inkjet print and then the imaging component relatively backward performing inkjet print at the delay distance d;

otherwise, the imaging components forward and backward in the color module performing inkjet print at the same time.

8. The control method according to claim 7, wherein the imaging component relatively backward performs print for a distance of L-d in the first cycle of intermittent print.

9. An apparatus for controlling multicolor overprint applicable to an intermittent print device, comprising:

a uniform-speed section parameter calculating module configured to obtain a start time signal of a uniform-speed section in an intermittent motion cycle of the intermittent print device;

a first color module jet-print module configured to set the intermittent print device to start operation upon detection of the start time signal of the uniform-speed section so that the first color module starts inkjet print until an end time of the uniform-speed section, wherein the color module is a module into which multiple spliced imaging components in the same color are combined; and an another-color module jet-print module configured to cause a next color module following the end of motion in the uniform-speed section of the current color module to start inkjet print together with a next color start time signal of a next color uniform-speed section until the end time of the next color uniform-speed section and to repeat the foregoing process until all the color modules in colors finish print.

10. The control apparatus according to claim 9, further comprising:

a color module spacing setting module configured to adjust a spacing between adjacent color modules so that the spacing between the adjacent color modules is N times a motion distance L in the uniform-speed section, wherein N is a positive integer.

11. The control apparatus according to claim 10, wherein after a period of time which is N times a motion period of time of the uniform-speed section elapses from a start time of the uniform-speed section of the current color module, the another-color module jet-print module causes the next color module to start inkjet print until the end time of the next color uniform-speed section.

12. The control apparatus according to claim 9, wherein the color module has a print breadth in the same color improved by splicing imaging components in the direction of an X axis, and a spacing between adjacent imaging components in the same color module in the direction of a Y axis is represented as d with $0<d<L$, and L represents a motion distance in the uniform-speed section.

13. The control apparatus according to claim 12, wherein the first color module jet-print module and the another-color module jet-print module perform inkjet print at the start times of the uniform-speed sections in such a way that an imaging component in the same color module relatively forward in the direction of the Y axis performs inkjet print and then an imaging component relatively backward performs inkjet print at the delay distance d.

14. The control method according to claim 2, wherein a print breadth in the same color is improved by splicing imaging components in the direction of an the X axis in the step (2).

15. The control method according to claim 3, wherein a print breadth in the same color is improved by splicing imaging components in the direction of the X axis in the step (2).

16. The control apparatus according to claim 10, wherein the color module has a print breadth in the same color improved by splicing imaging components in the direction of the X axis, and a spacing between adjacent imaging components in the same color module in the direction of the Y axis is represented as d with $0<d<L$, and L represents a motion distance in the uniform-speed section.

17. The control apparatus according to claim 11, wherein the color module has a print breadth in the same color improved by splicing imaging components in the direction of the X axis, and a spacing between adjacent imaging components in the same color module in the direction of the Y axis is represented as d with $0<d<L$, and L represents a motion distance in the uniform-speed section.

* * * * *